US010542597B2

(12) United States Patent
Ng

(10) Patent No.: US 10,542,597 B2
(45) Date of Patent: Jan. 21, 2020

(54) LIGHTING CONTROL CIRCUIT AND METHOD FOR MULTIPLE LEDS

(71) Applicant: SIGNIFY HOLDING B.V., Eindhoven (NL)

(72) Inventor: Poh Ng, Winchester, MA (US)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 15/757,741

(22) PCT Filed: Sep. 2, 2016

(86) PCT No.: PCT/EP2016/070733
§ 371 (c)(1),
(2) Date: Mar. 6, 2018

(87) PCT Pub. No.: WO2017/042101
PCT Pub. Date: Mar. 16, 2017

(65) Prior Publication Data

US 2018/0352622 A1 Dec. 6, 2018

Related U.S. Application Data

(60) Provisional application No. 62/217,543, filed on Sep. 11, 2015.

(51) Int. Cl.
*H05B 33/08* (2006.01)

(52) U.S. Cl.
CPC ..... *H05B 33/0827* (2013.01); *H05B 33/0866* (2013.01)

(58) Field of Classification Search
None
See application file for complete search history.

(56) References Cited

U.S. PATENT DOCUMENTS 6,608,450 B2 * 8/2003 Lestician ..... H05B 41/2925 315/219
8,410,727 B2 * 4/2013 Mizuno ..... H05B 33/0818 315/209 R (Continued)

FOREIGN PATENT DOCUMENTS

CN 103269540 A 8/2013

OTHER PUBLICATIONS

Subramanian, Kaushik, "EZ-Color-Implementing a Multi-Channel DALI Receiver System," Cypress Perform, Document No. 001-47615, Rev. A, Apr. 2011 (14 Pages).

*Primary Examiner* — Dion Ferguson
*Assistant Examiner* — Srinivas Sathiraju
(74) *Attorney, Agent, or Firm* — Akarsh P. Belagodu

(57) ABSTRACT

A lighting control circuit (10) for controlling a plurality of LEDs (24, 26). The lighting control circuit (10) includes a current source (12) coupleable to a first LED (20) and a second LED (22); a first switch (24) configured to switch from an open position to a closed position when driven by a first drive signal (V3), wherein the first switch (24) is positioned to interrupt current flow ($I_{out}$) through the first LED (20) when the first switch (24) is in the open position; a second switch (26) configured to switch from an open position to a closed position when driven by a second drive signal (V4), the second drive signal (V4) being temporally non-overlapping with respect to the first drive signal (V3), wherein the second switch (26) is positioned to interrupt current flow ($I_{out}$) through the second LED (22) when the second switch (30) is in the open position.

13 Claims, 9 Drawing Sheets

(56) References Cited

U.S. PATENT DOCUMENTS

| | | | | |
|---|---|---|---|---|
| 9,246,403 | B2 * | 1/2016 | Siessegger | H05B 33/0806 |
| 2006/0197469 | A1 * | 9/2006 | Kim | H05B 33/0815<br>315/291 |
| 2008/0290815 | A1 * | 11/2008 | Yamada | H05B 33/0815<br>315/294 |
| 2009/0167197 | A1 * | 7/2009 | Wang | H05B 33/0815<br>315/185 R |
| 2009/0256723 | A1 * | 10/2009 | Peddie | G08G 1/096783<br>340/907 |
| 2010/0007292 | A1 * | 1/2010 | Horino | H05B 33/0863<br>315/312 |
| 2010/0110682 | A1 * | 5/2010 | Jung | H05B 33/0869<br>362/249.02 |
| 2010/0148703 | A1 * | 6/2010 | Mizuno | H05B 33/0818<br>315/312 |
| 2011/0121755 | A1 * | 5/2011 | Han | H05B 33/0815<br>315/294 |
| 2012/0176048 | A1 * | 7/2012 | Li | H05B 33/0815<br>315/186 |
| 2014/0300274 | A1 * | 10/2014 | Acatrinei | H05B 33/0815<br>315/85 |
| 2015/0035441 | A1 * | 2/2015 | Hasegawa | H05B 33/0815<br>315/178 |
| 2015/0076999 | A1 * | 3/2015 | Malinin | H05B 33/0815<br>315/186 |

* cited by examiner

LIGHTING CONTROL CIRCUIT AND METHOD FOR MULTIPLE LEDS

CROSS-REFERENCE TO PRIOR APPLICATIONS

This application is the U.S. National Phase application under 35 U.S.C. § 371 of International Application No. PCT/EP2016/070733, filed on Sep. 2, 2016, which claims the benefit of U.S. Patent Application No. 62/217,543, filed on Sep. 11, 2015. These applications are hereby incorporated by reference herein.

FIELD OF THE INVENTION

The present disclosure is directed generally to a lighting control circuit and method for controlling multiple LEDs.

BACKGROUND

LED lighting devices are quickly replacing the once-ubiquitous incandescent bulbs. There are many advantages to LED lighting devices: for example, LEDs are longer lasting and offer a higher lumen output while using less power than traditional incandescent bulbs. Further, LED lighting devices offer a wide array of possible color temperatures, allowing a user to customize the feel his or her living space or other lighted area. For example, a user may employ a 2700K LED lighting device, offering a warm color temperature, for a comfortable setting. Or a user may use a 6500K LED lighting device, offering a bright color temperature, where bright, clear light is needed, such as for a commercial display.

Often it is desirable to adjust the color temperature of a single lighting device to emit a warmer or cooler color temperature, at any given time. Such a lighting device may be useful for tuning the light of the environment to the match the current daylight. For example, the lighting device may produce bright cool light during midday and warm light during early mornings and evenings.

However, a typical lighting device that can offer both warm and cool colors often requires an isolation power supply along with two LED drivers on the secondary side. In this scenario, there is a total of three power stages, which is complicated, expensive, and lumen inefficient. For example, if the specification requires a total output power of 50 W, a typical design would be 200 W driver (50 W for PFC/another 50 W for DC-DC and 100 W for the two LED drivers). The total power would be 50 W+50 W+100 W=200 W. (Some designs utilize a single stage AC-DC PFC that is integrated PFC and DC-DC into 1 power stage. With such designs, the total power will be 50 W+100 W=150 W). The power conversion system total efficiency is a multiplicative of each power stage. Thus, if a three stage power conversion topology is employed and the power conversion efficiency of each stage is 90%, then the system efficiency will be 72.9%. Further, controlling the lumen output of a variety of LEDs (or LED strings), each having a unique color temperature, generally requires multiple controller channels, which is costly and bulky.

Accordingly, a need exists in the art for a lighting control circuit that may control a variety of LEDs without the need for an LED driver for each LED, and that only uses a single current source for different LED channels via proper multiplexing and control.

SUMMARY OF THE INVENTION

The present disclosure is directed to a lighting control circuit configured to control multiple LEDs without the need for an LED driver for each LED or LED string, and that only requires a single current source. Coupled to a plurality of LEDs or LED strings, the lighting control circuit requires only a single pulse-width modulated drive signal for each LED or LED string, allowing for a simple and inexpensive circuit for controlling a lighting device. The lighting control circuit utilizes multiple switches that are each operable to interrupt the flow of current through a respective LED or LED string. The switches are driven by temporally non-overlapping drive signals, such that the LEDs or LED strings may be illuminated at different times during a single period. Thus, the relative lumen output of each LED or LED string may be modified by simply varying the duty cycle of the drive signals.

Generally in one aspect, a lighting control circuit is provided. The light control circuit includes: a current source coupleable to deliver a current to a first LED and a second LED; a first switch configured to switch from an open position to a closed position when driven by a first drive signal, wherein the first switch is positioned to interrupt current flow through the first LED when the first switch is in the open position; a second switch configured to switch from an open position to a closed position when driven by a second drive signal, the second drive signal being temporally non-overlapping with respect to the first drive signal, wherein the second switch is positioned to interrupt current flow through the second LED when the second switch is in the open position.

According to an embodiment, the first LED and the second LED emit different color temperatures during operation.

According to an embodiment, the lighting control circuit further comprises a controller configured to alter brightness of the first LED and the second LED by adjusting a duty cycle of the first drive signal and a duty cycle of the second drive signal.

According to an embodiment, the lighting control circuit further comprises: a current control loop comprising: an error amplifier, configured to receive at a first input a sense voltage being proportional the current flowing through LED strings, and to receive at a second input a reference voltage, and to output an error voltage, wherein the error voltage is proportional to the difference between the sense voltage and the reference voltage; a comparator, configured to receive at a first input the error voltage, and at a second input a comparison voltage, the comparison voltage being a saw-tooth wave, and to output a control voltage, wherein the duty cycle of the control voltage is set by the magnitude of the error voltage, wherein the current source is configured to adjust the magnitude of the output current in proportion to the duty cycle of the control voltage.

According to an embodiment, the reference voltage is set to a first value when the first switch is in the closed position, and to a second value when the second switch is in the closed position.

According to an embodiment, the reference voltage is set to the first value for a first time period, wherein the first time period begins after the first switch is in the closed position, and ends before the first switch is in the open position, and is set to the second value for a second time period, wherein the second time period begins after the second switch is in the closed position, and ends before the second switch is in the open position.

According to an embodiment, the reference voltage is set to 0V for a first time period and a second time period, wherein the first time period begins after the first switch is in the closed position and before the second switch is in the open position, wherein the second time period begins after the second switch is in the closed position and before the first switch is in the open position.

According to an embodiment, the lighting control circuit further comprises: first voltage source having a first voltage value being configured to set the value of the reference voltage to the first voltage value when a first switch is in a closed position; and a second voltage source having a second voltage value being configured to set the value of the reference voltage to the second voltage value when a second switch is in a closed position.

According to an embodiment, wherein the first switch is driven into a closed position by a first switch drive signal and the second switch is driven into a closed position by a second switch drive signal.

According to an embodiment, the lighting control circuit further comprises: a switch control circuit, comprising: a first branch, including a first comparator configured to output the first drive signal when the value of a comparison signal exceeds the value of a first switch signal, and including a second comparator configured to output the first switch drive signal when the value of the comparison signal exceeds the value of a second switch signal; a second branch, including a third comparator configured to output the second drive signal when the value of the comparison signal falls below the value of a third switch signal, and including a fourth comparator configured to output the second switch drive signal when the value of the comparison signal falls below the value of a fourth switch signal.

According to an embodiment, the value of the second switch signal is higher than the value of the first switch signal, the value of the first switch signal is higher than the value of the third switch signal and the value of the third switch signal is higher than the value of the fourth switch signal.

According to an embodiment, the lighting control circuit further comprises a controller configured to detect the current delivered to the first LED and the second LED, and to a send a control signal to the current source to adjust the current such that a desired lumen output is achieved for both the first LED and the second LED, when each is illuminated.

Generally in another aspect, a lighting control method is provided. The lighting control method includes the steps of: delivering, with a current source, a current to a first LED and second LED; driving, with the first drive signal, a first switch from an open position to a closed position, wherein the first switch is configured to interrupt the current flow through the first LED when the first switch is in the open position; and driving, with the second drive signal, a second switch from an open position to a closed position, wherein the second drive signal is temporally non-overlapping with respect to the first drive signal, wherein the second switch is configured to interrupt current flow through the second LED when the second switch is in the open position.

According to an embodiment, the method further comprises the steps of detecting the current delivered to the first LED and the second LED, and sending a second control signal to the current source to adjust the current such that a desired lumen output is achieved for both the first LED and the second LED, when each is illuminated.

According to an embodiment, the step of sending the second control signal is performed by a current control loop.

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "controller" is used herein generally to describe various apparatus relating to the operation of one or more LEDs. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs). Due to the various types of "controllers," any one of which may be suitable for use in accordance with any aspects of the present invention, controllers will be described as being "configured, programmed and/or structured" to perform a stated function, thus encompassing all possible forms of "controller."

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein.

These and other aspects of the invention will be apparent from and elucidated with reference to the embodiment(s) described hereinafter.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION OF EMBODIMENTS

The present disclosure describes various embodiments of a device for controlling multiple LED strings using non-overlapping drive signals. More generally, Applicant has recognized and appreciated that it would be beneficial to control the lumen output of a variety of LEDs without the need for an LED driver for each LED or LED string. Accordingly, the device described or otherwise envisioned herein provides a lighting control circuit configured to control multiple LEDs without the need for an LED driver for each LED or LED string, and that only uses a single current source. Coupled to a plurality of LEDs of LED strings, the lighting control circuit requires only a single pulse-width modulated drive signal for each LED or LED string, allowing for a simple and inexpensive circuit for controlling a lighting device. The lighting control circuit utilizes multiple switches that are each operable to interrupt the flow of current through a respective LED or LED string. The switches are driven by temporally non-overlapping drive signals, such that LEDs or LED strings may be illuminated at different times during a single period. Thus, the relative lumen output of each LED or LED string may be modified by simply varying the duty cycle of the drive signals.

Although the method and system described below is described in connection with LED strings, the circuit could be applied to virtually any device that requires temporally non-overlapping drive signals.

Figure 1:
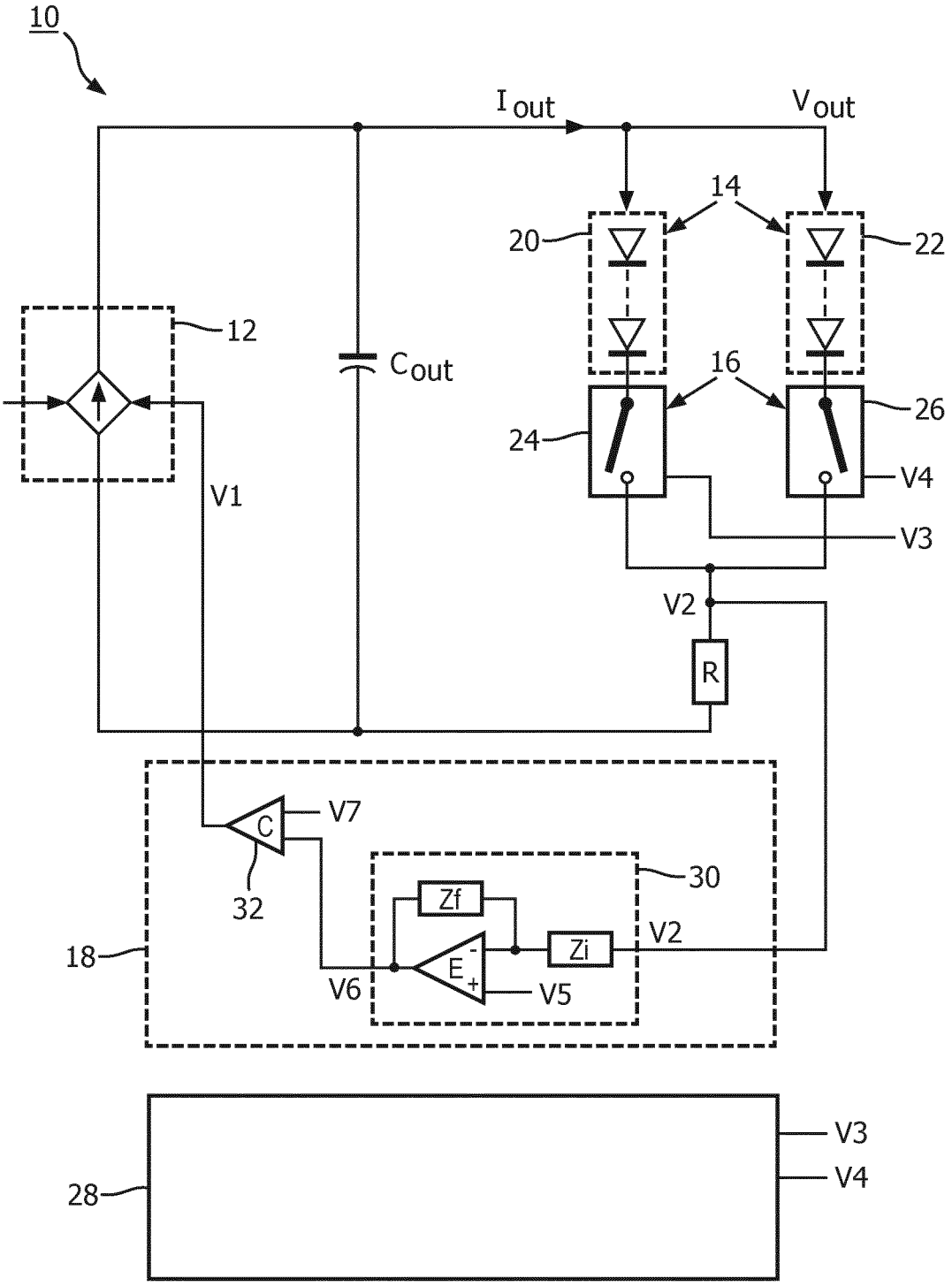
FIG. 1 is a schematic of a lighting control circuit according to an embodiment.

Referring now to FIG. 1 wherein like reference numerals refer to like parts throughout there is seen a schematic of an embodiment of lighting control circuit 10. As shown, lighting control circuit 10 may include a current source 12, LED strings 14, switches 16, and current control loop 18.

In one embodiment, current source 12 may be a single stage PFC or a two stage PFC/DC-DC converter or any other current source suitable for powering one or more LED strings. Current source 12 may be either a non-isolated or an isolated power converter. Examples of non-isolated power converters are buck, boost, buck-boost, etc. Examples of isolated power converters are forward, flyback, push-pull, half-bridge, full-bridge, etc. The output of current source 12, $I_{out}$, may be controlled by a current control signal V1 received from current control loop 18, or other another control circuit or controller. The current may be adjusted by lowering the magnitude of $I_{out}$, or by modulating $I_{out}$, such as with pulse-width modulation, to provide an average lower current. The resulting voltage drop across the remaining elements in current control circuit 10 is identified in FIG. 1 as $V_{out}$.

Current control loop 18 may also sense the current output of LED strings 14. Because sensing a voltage is simpler than sensing a current (and because current control loop 18, and most controllers, receive voltage inputs), a current sense resistor R may be placed in series with the output of LED strings 14. Current sense resistor may be sized to create a nominal detectable voltage V2 at the output of LED strings 14 that will be proportional to the current output of LED strings 14.

In one embodiment, LED strings 14 are comprised of at least two LED strings 20, 22. LED strings 20, 22 may be in a parallel relationship with each other with respect to the current source 12, such that they may each independently receive current from current source 12. LED strings 20, 22, and any additional LED strings, may each have one or more LEDs. Further, each string of LED strings 14 may have a contrasting color temperature. For example, LED string 20 may be comprised of 2700K LEDs, generally considered a warm color temperature, while LED string 22 may be comprised of 6500K LEDs, generally considered a cool color temperature. However, in alternate embodiments, LED strings 20, 22 may have the same or nominally different color temperatures. In embodiments of more than two LED strings, each additional LED string may have a unique color temperature or a color temperature in common with at least one other LED string.

In some embodiments, LED strings 14 may not be part of lighting control circuit 10, but rather may be attachable to lighting control circuit 10.

Switches 16, as shown, may be comprised of switches 24, 26. In one embodiment, switches 16 are each, respectively, in a series relationship with one LED string of LED strings 14. However, it should be understood that switches 16 may be positioned at any location suitable to interrupt current flow through one respective LED string of LED strings 14.

Each of the switches 16 may be comprised of a MOSFET, power MOSFET, BJT, SER, or any other transistor or circuit suitable for interrupting current flow through LED strings 14, in response to a drive signal. For example, switch 24 may receive drive signal V3 and switch 26 may receive drive signal V4. Lighting control circuit 10 is not limited to two switches, but instead may have as many switches as controllable LED stringseach switch positioned to interrupt the current flow through an LED string of LED strings 14. The drive signals may be gate drive signals, or in the case of BJT transistors a base drive signal.

In an embodiment, drive signals V3, V4 may be provided by a controller 28. Controller 28 may implement and be controlled by any digital standard such as DALI 1.0, 2.0, 209, WIFI, BLUETOOTH, ZIGBEE, DMX, etc., for adjusting the V3, V4 or any other function performed by controller 28. In an alternate embodiment, drive signal V3, V4 may be provided a control circuit (i.e. control circuit 44 described below).

In operation, controller 28 sends control signal V3, V4 to switches 24, 26. In an embodiment, control signals V3, V4 are non-overlapping. In other words, when control signal V3 is high (such that switch 24 would enter a closed position), drive signal V4 is low, and when control signal V4 is high, control signal V3 is low. Thus, temporally, drive signals V3, V4 are non-overlapping. As a result, only one of switches 16 is opened at a time, and only one LED string of LED strings 14 is conducting current: when drive signal V3 is high, switch 24 is conducting, when drive signal V4 is high, switch 26 is conducting. Because the period of drive signals V3, V4 is rapid, and due to the natural persistence of the human eye, there is no perception that LEDs 14 are switching on and off; instead, the eye perceives that a composite color has been created (i.e. a mixture of the colors temperatures of each LED string 14). This composite color may be adjusted by varying the duty cycle of drive signals V3, V4. This allows mixing the colors of multiple LED strings 14 to achieve a single color point, where each LED 14 string is homogeneously composed of LEDs of a certain color temperature.

For example, if drive signal V3 has a high percentage duty cycle, and drive signal V4 has a low duty cycle, LED string 20 will remain on for a longer period of time than LED string 22, per period. Thus, the color temperature of LED string 20 will dominate the perceived color temperature. Whereas, if drive signal V3 has a low percentage duty cycle, and drive signal V4 has a percentage duty cycle, LED string 22 will remain illuminated for a longer period of time per period, and the color temperature of the LED string 22 will dominate the perceived color temperature. In this way, the composite color temperature of illuminated LED strings 14 may be varied by adjusting the duty cycle of drive signals V3, V4.

In an embodiment, the drive signals V3, V4 may be complementary (thus, V4=1−V3), rather than simply temporally non-overlapping.

Figure 2:
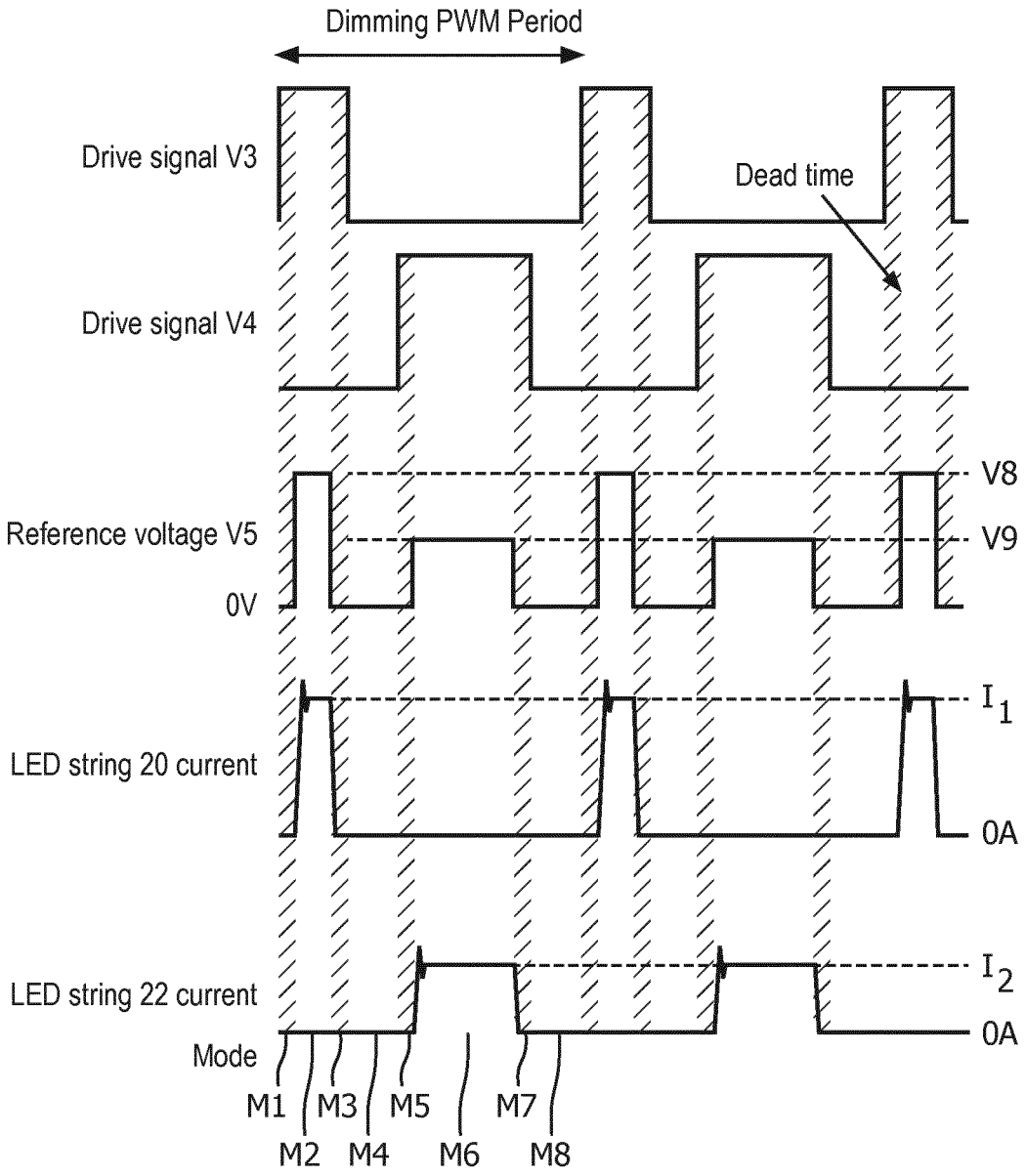
FIG. 2 is a graph of signals present in a lighting control circuit according to an embodiment.

FIG. 2 shows a graph of drive signal V3, drive signal V4, the current through LED string 20, and the current through LED string 22, with respect to time. As shown, because drive signals V3, V4 are non-overlapping, when drive signal V3 is high, drive signal V4 is low. Thus, when drive signal V3 is high, LED string 20 is conducting but LED string 22 is not conducting. And conversely, when drive signal V4 is high, LED string 20 is not conducting, but LED string 22 is conducting.

In one embodiment, lighting control circuit 10 may further comprise a current control loop 18 configured to measure the current flowing through each LED string of LED strings 14 and adjust the output current $I_{out}$ of current supply 12. In an embodiment, control loop 42 may comprise an error amplifier 30 coupled to a comparator 32. Error amplifier 30 may be coupled to the output of LED strings 14, such that the current through each LED string 20, 22, may be detected. In an embodiment, error amplifier may be coupled to resistor R, at the output (or input, in an alternate embodiment) of LED strings 14, such that the current through each LED string 20, 22 may be measured as a proportional voltage, V2, across resistor R The output of error amplifier 30, error voltage V6 will depend upon the value of input voltage V2 as compared to reference voltage V5. In other words, the greater the difference between the value of the inputs, the higher the output, error voltage V6, will be. Thus, if the value of the input voltage V2 is significantly lower than reference voltage V5, error amplifier output, error voltage V6, will have a relatively high value. When input voltage V2 is near to, or the same as, reference voltage V5, the error amplifier output, error voltage V6, will be relatively low.

Error amplifier 30 may include a compensation network comprising Zf and Zi. In an alternative embodiment, Zi may be an amplifier having some gain G. The error voltage V6 can be written in terms of the Laplace equation:

$$B(s) = \frac{Zf(s)}{Zi(s)} A(s)$$

At DC condition, s=0, and the above becomes $$B = \frac{Zf(0)}{Zi(0)} A$$

The output of error amplifier 30 may be coupled to an input terminal of comparator 32, such that the output voltage of error amplifier 30, error voltage V6, is applied to an input terminal of comparator 32. The other terminal of comparator 32 may receive comparison voltage V7, which, in one embodiment, is a sawtooth waveform. Comparator, including comparison voltage V7, may be implemented by any PWM controller IC as are known in the art, such as UC3842. In an embodiment, the output of comparator 32 is current control signal V1. The pulse-width of current control signal V1, in an embodiment, is proportional the magnitude of error voltage V6. Accordingly, a high magnitude of error voltage V6 will result in a high current control signal V1 pulse-width. Whereas a low magnitude of error voltage V6 will result in a low current control signal V1 pulse-width. In embodiments using an isolated LED driver, an optocoupler may be used isolate error voltage V6.

The output of comparator 32 may be coupled to current source 12, such that the comparator 32 output voltage, current control signal V1 is applied to an input terminal or other control point of current supply 12. In an embodiment, the output current $I_{out}$ is proportional to the pulse width of current control signal V1. Thus, a large pulse-width of current control signal V1 will result in a high output current $I_{out}$, and a low pulse-width of current control signal V1 will result in a low output current $I_{out}$.

In certain embodiments, loop 18 and/or error amplifier 30 can be implemented with a digital controller.

Generally, in an embodiment, current control loop 18 operates as follows. At the outset, no current is applied to either LED string of LED strings 14 and the switches 24, 26 of switches 16 are open. Both input voltage V2 and reference voltage V5 may be at zero. Once reference voltage reference voltage V5 goes high (the operation of this will be discussed below), reference voltage V5 is greater than input voltage V2 and thus error voltage V6 will rise to a higher voltage. As a result, comparator 32 will begin to output a current control signal V1 with a large pulse-width. Current source 12, receiving the large pulse-width current control signal V1, will begin to provide a proportionally large output current $I_{out}$ to LED strings 20, 22 (whichever is currently conducting as a result of a closed switch 24, 26). The resulting current through one LED strings 20, 22, will result in a voltage drop, input voltage V2, across resistor R. Because input voltage V2 is now higher (and proportional to current $I_{out}$), the difference between input voltage V2 and resistor R is diminished. Accordingly, the output error voltage V6 will decrease, reducing the pulse-width of current control signal V1 and consequently lowering the magnitude of $I_{out}$. Input voltage V2 may fluctuate until it reaches a steady-state point that is substantially equivalent to reference voltage V5. Accordingly, the higher the value of reference voltage V5 the higher the resulting steady-state current $I_{out}$ will be. The steady-state will continue until the currently conducting switch 24, 36 opens or reference voltage V5 is reduced to a lower value.

Further, because output current $I_{out}$ is proportional to the reference voltage V5, the current for each LED string may be varied by applying a unique reference voltage V5 value during the operation of each LED string of LED strings 14. For example, during the operation of LED string 20 (i.e. when switch 24 is closed), reference voltage V5 may be set to a high voltage so that the current through LED string 20 will be high, whereas when during the operation of LED string 22, reference voltage V5 may be set to a low voltage so that the current through LED string 22 will be lower. As shown in FIG. 2, when reference voltage V5 is set to value V8, the value of the current $I_{out}$ through LED string 20 is $I_1$. When the reference voltage V5 is set to value V9, the value of the current $I_{out}$ through LED string 22 is $I_2$. Thus a higher reference voltage V5 value V8, results in a higher LED string current $I_1$. Accordingly, the output current $I_{out}$ may be controlled by the value of reference voltage V5. Of course, these are just examples, and reference voltage V5 may be set to any value for any LED string of LED strings 14, to achieve the desired current through the LED string.

Varying the output current $I_{out}$ during the relative operation of each LED string 14 may be desirable in order to compensate for the lumen output of varying compositions of each LED string 14. In other words, LED string 20 may be comprised of type of LED that emits a certain lumen output for a given amount of received power, whereas LED string 22 may be comprised of a different type of LED that emits a different lumen output for the same amount of received power. Accordingly, in order to regulate the lumen output of each LED string of LED strings 14, so as to, for example, emit the same amount of lumens while each LED string is illuminated, it is desirable to be able to control the amount of current flowing through each LED string while it is illuminated. As described above, this may be accomplished, in one embodiment, by varying reference voltage V5 for each respective LED string of LED strings 14. Note that the perceived lumen output that is accomplished by driving LED strings 14 with non-overlapping drive signals V3, V4, is distinct from the concept of the lumen output of each LED string of LED strings 14 when it is illuminated.

More specifically, current control loop 18 can be said to operate in eight distinct modes, as depicted in FIG. 2, according to an embodiment. FIG. 2 shows the modes with respect to various signals of lighting control circuit 10 across several dimming PWM periods, including: drive signal V3, drive signal V4, reference voltage V5, LED string 20 current, and LED string 22 current.

Generally, in Mode 1 (M1), drive signal V3 is high, but current is not flowing through LED string 20 because reference voltage V5 is still at 0V and thus current $I_{out}$ is zero. Mode 1 (M1) ends when reference voltage V5 turns on.

Mode 2 (M2) begins when reference voltage V5 is set to voltage value V8. As a result of reference voltage V5 being set to voltage value V8, current source 12 will begin to conduct. Because switch 24 is closed, LED string 20 current will rise from 0A to the steady state current $I_1$. The steady state current level $I_1$ level may determined by the following formula, $$I_1 = V8/R$$

In an embodiment where an amplifier has been inserted at the negative input of error amplifier 30, to boost input voltage V2, the formula becomes $$I_1 = G*V8/R$$

Where G is the gain of the amplifier at the negative input terminal. The purpose of the additional non-inverting gain is to allow a lower value of R to be used in order to reduce power loss as a result of resistor R and to improve signal to noise ratio. Mode 2 (M2) ends when reference voltage V5 is 0V again.

Mode 3 (M3) begins when reference voltage V5 again drops to 0V (or some other negligible voltage) while drive signal V3 is still high. At this stage, the output current decays to 0A because reference voltage V5 is again low. As will be discussed in depth below, it is advantageous that reference voltage V5 remains low long enough for the output capacitance $C_{out}$ of the current supply 12 (represented in FIG. 1 as the capacitor $C_{out}$) to deplete as much charge as possible before next LED string 22 (or other LED string of LED string 14 in alternate embodiments) conduction begins. Else, the excessive charge of $C_{out}$ will cause a current overshoot during the next LED string 22 turn on time. Mode 3 (M3) ends when drive signal V3 drops to low.

Mode 4 (M4) represents the idle period when all signals are 0V and 0A. This period is use as PWM dimming. Mode 4 (M4) ends when drive signal V4 goes high. Mode 5-8 (M5-M8) are repetition of Modes 1-4 (M1-M4) for LED string 22. At the end of Mode 8 (M8), the system completes a PWM dimming cycle. It should be noted, however, that for Modes 5-8 (M5-M8), reference voltage V5 is set to voltage value V9, which is lower than voltage value V8. As a result, the current through LED string 22, $I_2$, is lower than the current through LED string 20, $I_1$.

The idle times of Modes 4 and 4 (M4, M8) represent periods where neither LED string 20, 22 is conducting. Accordingly, the width of Modes 4 and 8 (M4, M8) may be adjusted to change the perceived brightness of LED strings 20, 22. Thus, dimming may be effectuated by widening Modes 4 and 8 (M4, M8). Because changing the relative brightness of one with LED string of LED string 14 with respect to another may change the color point of the emitted light, it may be desirable, when dimming, to adjust Modes 4 and 8 such that that ratio of on time for each LED string 20 and 22 remains the same. For example, if, at full brightness, LED string 20 is on for 70% of a dimming period and LED string 22 is on for 30% of the dimming period, when being dimmed to 10% of the full output, Modes 4 and 8 (M4, M8) may be adjusted such that LED string 20 is on for 7% of the dimming period and LED string 22 is on for 3% of the dimming period. In this way, the color point of the emitted light will remain at the desired point, but the overall brightness will be dimmed to 10%.

Of course, reference voltage V5 and drive signals V3, V4 need to be high in order for current to conduct, the idle times may be implemented by varying the drive signals V3, V4, such that neither will conduct for a period of time.

Figure 3:
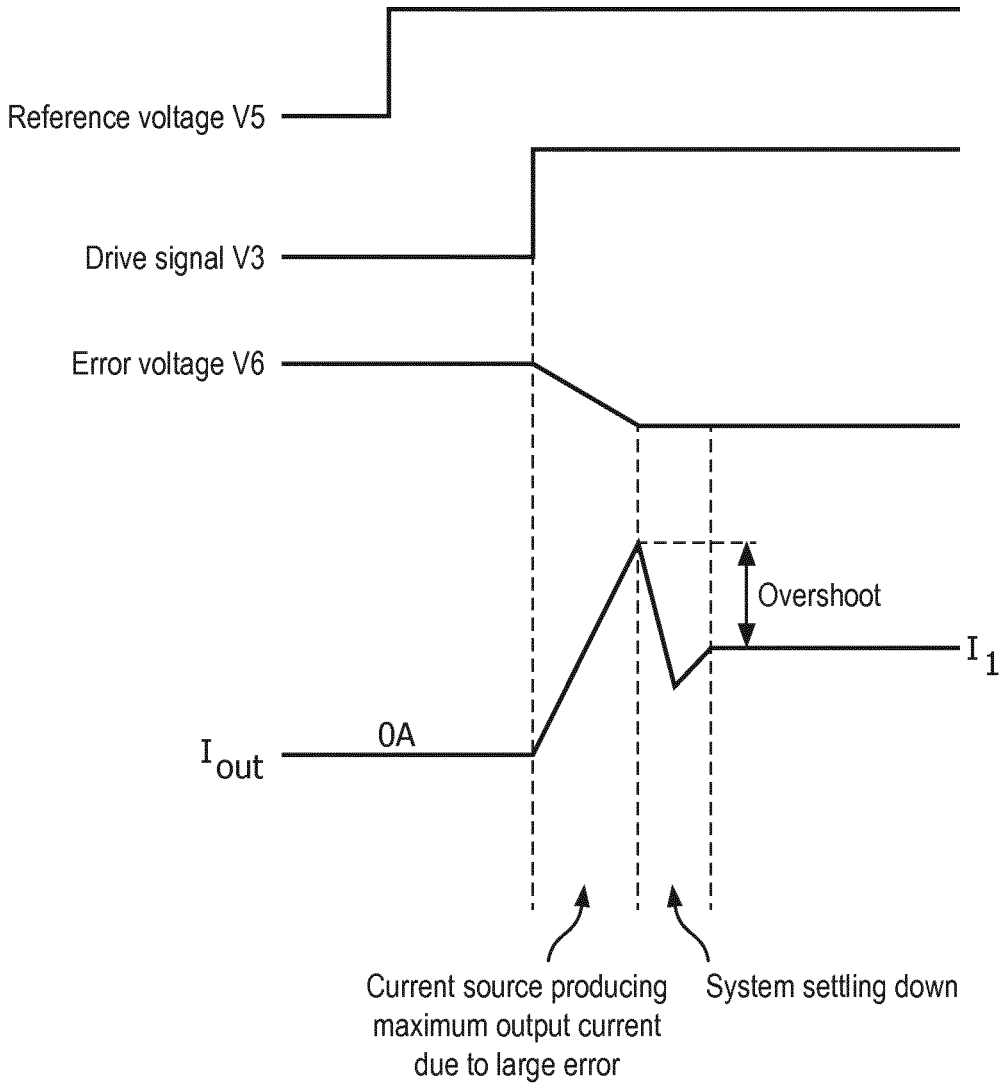
FIG. 3 is a graph of signals present in a lighting control circuit according to an embodiment.

Modes 1, 3, 5, and 7 (M1, M3, M5, M7) can be used as deadtimes in the controller design—i.e. where no current is flowing through either LED strings 20, 22. The purpose of deadtime is to mitigate LED current overshoot. Current overshoot, as depicted in FIG. 3, occurs where current spikes above the steady-state set point. Both lumen and color temperature of an LED are a function of its ampere current. Therefore, overshoot current during can shift the color temperature and lumen of an LED from its set points.

Figure 4:
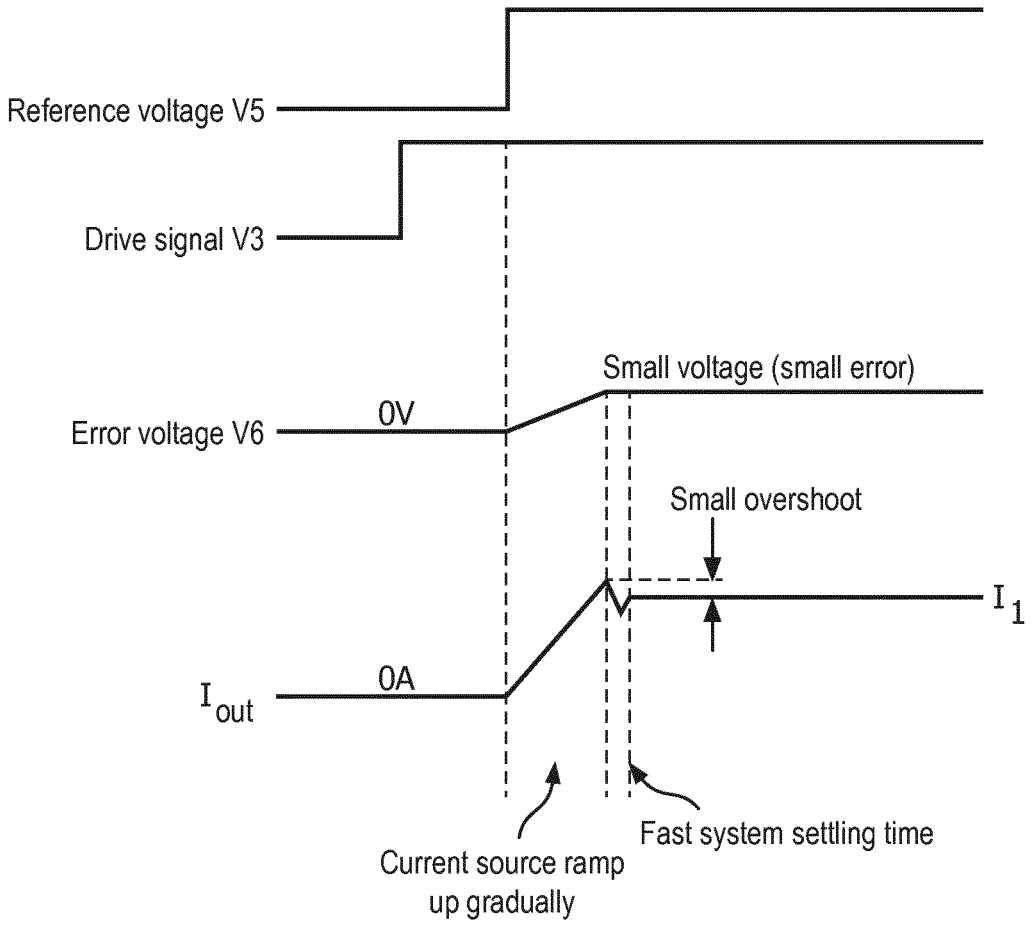
FIG. 4 is a graph of signals present in a lighting control circuit according to an embodiment.

Although overshoot is generally determined and mitigated by the values of compensation network (Zf and Zi), other electrical factors may contribute to the overshoot:

First, as shown in FIG. 4, if reference voltage V5 is high before the switch is closed, error voltage V6 will be very high due to the large differential input voltage (reference voltage V5 minus input voltage V2). Indeed, error amplifier 30 may be at saturation (typically the V of the omp-amp). Since the current source output current is proportional to the error signal, once one of the switches 16 closes, the saturated error voltage V6 will initially produce a very large output current $I_{out}$, resulting in an overshoot before settling down to steady state at $I_1$.

To mitigate this overshoot current, reference voltage V5 may be set to a high signal (i.e., V8, V9) only after drive signal V3 or drive signal V4 is high, as shown in FIG. 4. As such, the initial error amplifier 30 output error voltage V6 begins at 0V and ramps up to a small steady state error. In doing so, the current source 12 output current $I_{out}$ (which is the same as LED current) will start from 0A rather than maximum current. Thus, the current overshoot and settling time will be drastically reduced.

Second, the discharge of the current source 12 output capacitance, $C_{out}$, may cause an overshoot if it is rapidly discharged through one of LED strings 14. More specifically, if the voltage of the charged output capacitance $C_{out}$ is greater than the voltage across LED strings 14 at the outset of the next conduction cycle, the excessive charge from $C_{out}$ will be instantaneously dumped into the LED string 14 resulting in the sharp overshoot. Accordingly, a deadtime may be introduced to allow the output capacitance $C_{out}$ to deplete its charges. In an alternate embodiment, having an auxiliary power tapped from the same current source will assist the charge depletion.

From the above, the on-time deadtime may be defined by the period of time wherein a switch 16 is in the closed position but current is not flowing through the respective LED string of LED strings 14. The off-time deadtime may be determined by conditions such as $Vcout<V_{out}$ as well as $I_1$, $I_2$=0A.

Figure 5:
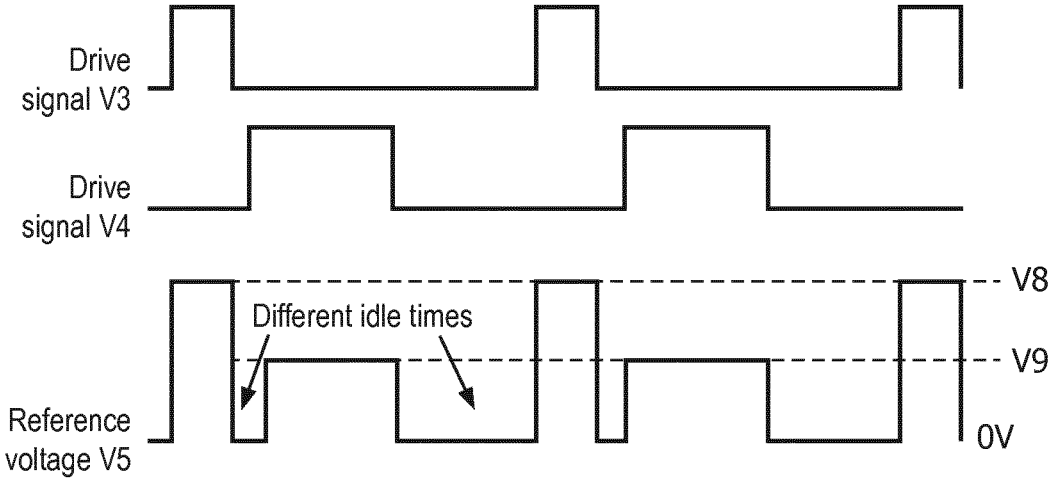
FIG. 5 is a graph of signals present in a lighting control circuit according to an embodiment.

As shown in FIG. 5, the deadtimes and idle times need not be symmetrical. For example, the idle time between opening switch 24 and closing switch 26 may be one length, and the idle time between opening switch 26 and closing switch 24 may be another length. It will be appreciated that the deadtimes and idle times may be set to any length as is suitable for mitigating overshoot or for controlling dimming. Further, the deadtimes and idle times may be varied period to period to account for conditions that affect current overshoot or dimming and that vary with time. Deadtimes and idle times may also be implemented for any number of LED strings in embodiments of more than two LED strings of LED strings 14.

Furthermore, controller 28 or a different controller may be used to vary drive signal V3, and V4 to implement the deadtimes.

Figure 6:
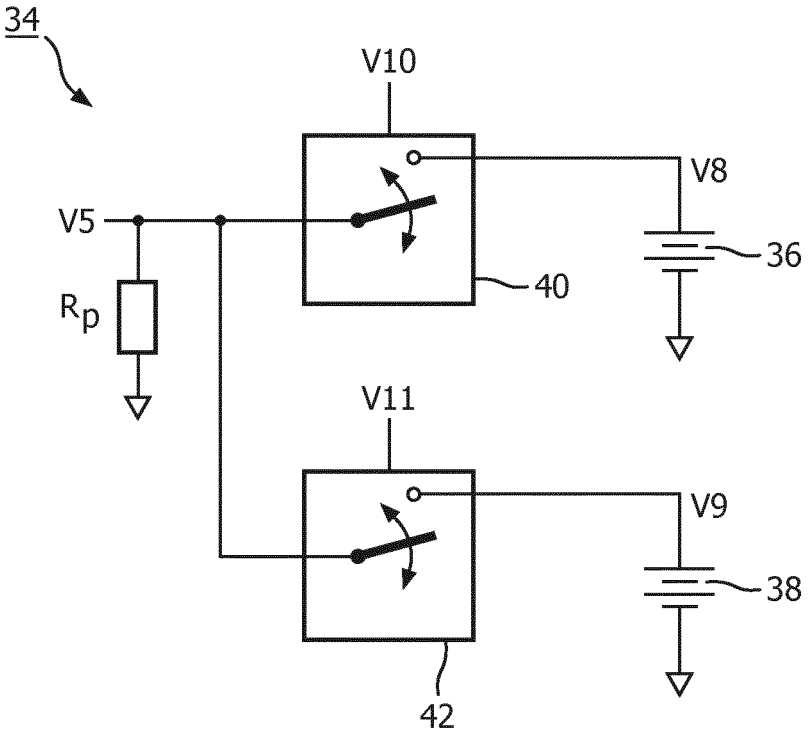
FIG. 6 is a schematic of a reference control circuit according to an embodiment.

Setting the value of reference voltage V5 may be accomplished by firmware or a controller, such as controller 28. In an alternate embodiment, a circuit such as reference control circuit 34 may alter the value of reference voltage V5. As shown in FIG. 6, control circuit 34 may comprise two voltage sources 36, 38, each generating a different voltage value: V8, V9, respectively. Voltage sources 36, 38 are respectively coupled, via switch 40, 42, to a summing node that is coupled to the reference voltage V5 input (i.e., the positive terminal of error amplifier 30) of current control loop 18. Accordingly, when switch 40 is closed and switch 42 is open, reference voltage V5 is set to voltage value V8 by voltage source 36. When switch 40 is open and switch 42 is closed, reference voltage V5 is set to voltage value V9 by voltage source 58. In this way, the value of reference voltage V5 may be varied between voltage value V8 and voltage value V9 by altering switch 40, 42. Reference control circuit 34, in an embodiment, may further include pull-down resistor $R_P$, which pulls reference voltage V5 to ground when neither switch 56 nor switch 58 is closed. Each switch 40, 42 may be opened or closed by a switch drive signal V10, V11, respectively. In an embodiment, switches 40, 42 may be analog multiplexors, however other switches may be used as are known in the art. Additionally, reference voltage V5 may be modified to have a soft-start using a simple R-C rise time to slow down the LED string 14 current turn on time.

In alternate embodiments, any number of voltage sources may be used to set reference voltage V5. For example, if LED strings 14 is comprised of four LED strings, four different voltages sources may be used to set reference voltage V5 to a unique voltage value for each LED string. However, one of ordinary skill will appreciate that any number of reference voltages values may be used for any number of LED strings. For example, if three LED strings are employed, two of which require a similar current, two reference voltage values may be supplied by two voltage sources to the three LED strings. Similarly, where the reference voltage values are supplied by a controller such as controller 28, the controller may be configured to deliver any number of reference voltages for any number of LED strings.

Figure 7:
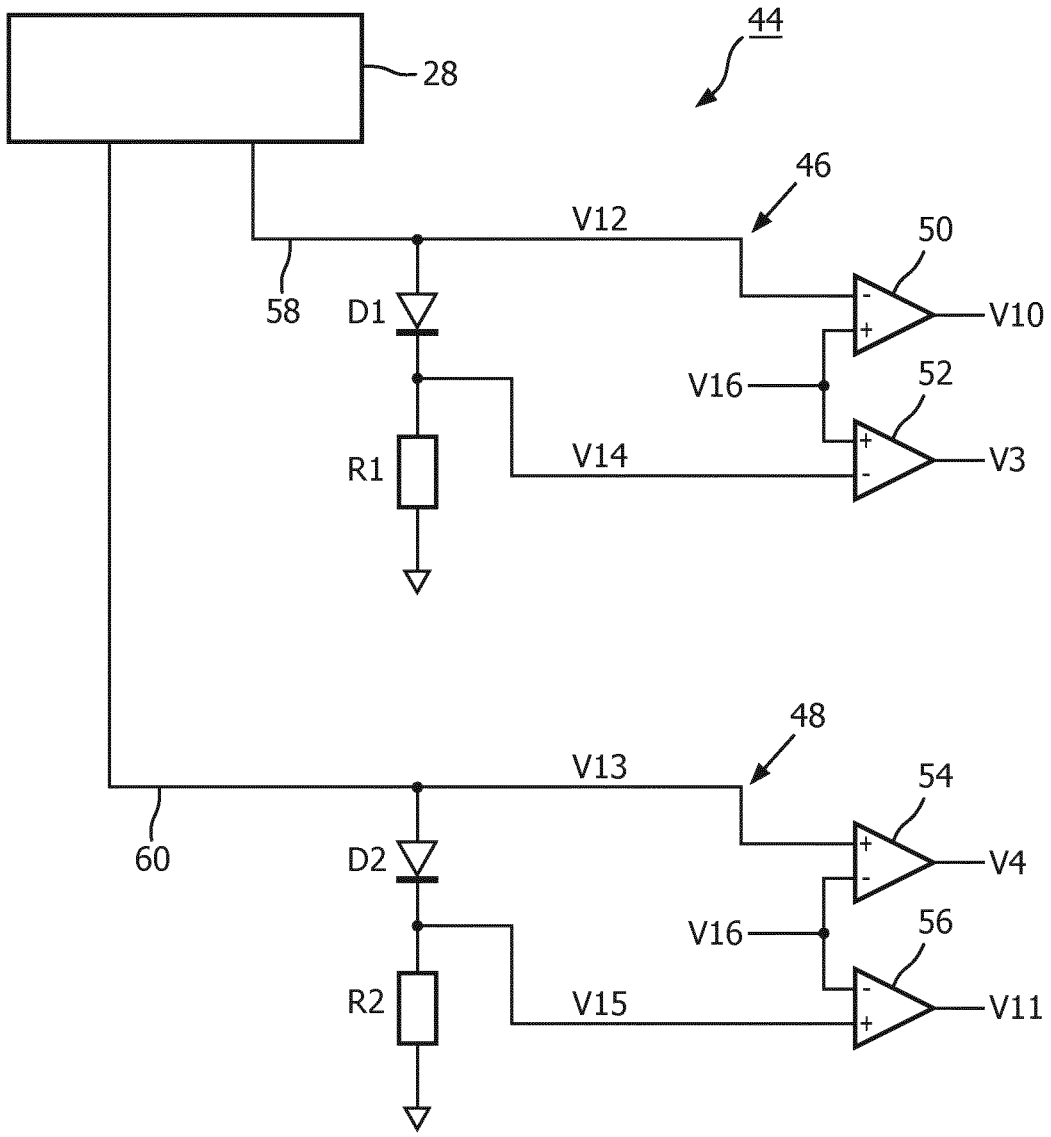
FIG. 7 is a schematic of a switch control circuit according to an embodiment.

As shown in FIG. 7, lighting control circuit 10 may further include switch control circuit 44, configured to provide switch control signal V10, V11, as well as drive signals V3, V4. In this embodiment, switch drive circuit 44 may replace or otherwise supplement controller 28 as it functions to generate drive signals V3, V4 or V10, V11.

In the embodiment shown in FIG. 7, drive circuit 44 may be comprised of two branches 46, 48, each having two comparators: branch 46 includes comparators 50, 52, and branch 48 includes comparators 54, 56. In an embodiment, comparators 52, 54 output drive signals V3, V4, respectively, and comparators 50, 56, output switch drive signals V10, V11, respectively.

Each branch 46, 48 is configured to receive a switching signal V12, V13, at input terminal 58, 60. Comparators 50, 54 are configured to receive switching signals V12, V13 at opposite terminals. For example, comparator 50 may receive switching signal V12 at the negative input, while comparator 54 may receive switching signal V13, at the positive terminal. The other terminal of comparators 50, 54 may be connected to comparison signal V16. In an embodiment, comparison signal V16 may be a triangle wave although other wave-types may be used in alternate embodiments.

Comparators 52, 76, in an embodiment, may be configured to receive an attenuated switch signal V14, V15. In an embodiment, switch signals V14, V15 may be formed by diode D1 and R1, and diode D2, and R2. Using branch 46 as an example, as shown, the anode of diode D1 may be coupled to the input terminal 58 such that diode D1 receives switch signal V12. The cathode of diode D1 may be connected to the negative terminal of comparator 52 and to resistor R1, which is tied to ground. In operation, current will flow through diode D1 and resistor R1 to ground, as a result of switch signal V12. Diode D1 will cause a 0.5-0.7 volt drop from the value of switch signal V12. The remainder forms switch signal V14 and is present at the negative input of comparator 52. Accordingly, the voltage drop across resistor R1 forms the switch signal V14, which is equal to the switch signal V12, minus the voltage drop across diode D1. It should be noted that the diode D1, in alternate embodiments, may be replaced by a resistor (forming a voltage divider with resistor R1) or any other constant voltage device. Similarly the value of R1 may be determined by the forward bias of diode D1.

Branch 48, in an embodiment, is configured like branch 44 except that switch signal V15 is applied to the positive, rather than negative, terminal of comparator 56. Further, the opposite terminals of comparators 52, 56 are connected to comparison signal V16. In other words, the positive terminal of comparator 52 is coupled to receive comparison signal V16 while the negative terminal of comparator 56 is coupled to receive comparison signal V16.

In sum, comparator 50 receives switch signal V12 at the negative input terminal and comparison signal V16 at the positive terminal, while comparator 52 receives switch signal V14 at the negative terminal and comparison signal V16 at the positive terminal. By contrast, comparator 54 receives switch signal V13 at the positive input terminal and comparison signal V16 at the negative input terminal, while comparator 56 receives switch signal V15 at the positive input terminal and comparison signal V16 at the negative input terminal.

In an embodiment, switch signals are constant voltages, descending from the highest voltage value in the following order: V12, V14, V13, V15 However, in alternate embodiments, other switch signal values may be used to attain different desired outputs (i.e. to vary the deadtimes, idle times, and conducting times). In yet another embodiment, switch signals may vary over time or upon some event such as a user input.

It should be noted FIG. 7 is only an illustrative example and may not be an optimal design, as there are many ways to implement electrical signals depending on system cost and performance requirements. For example, the timing for the drive signals or deadtimes can be generated using digital logic components, such as digital logic gate circuits. In other examples, the diming for the drive signals can be generated using microprocessors or microcontrollers.

Figure 8:
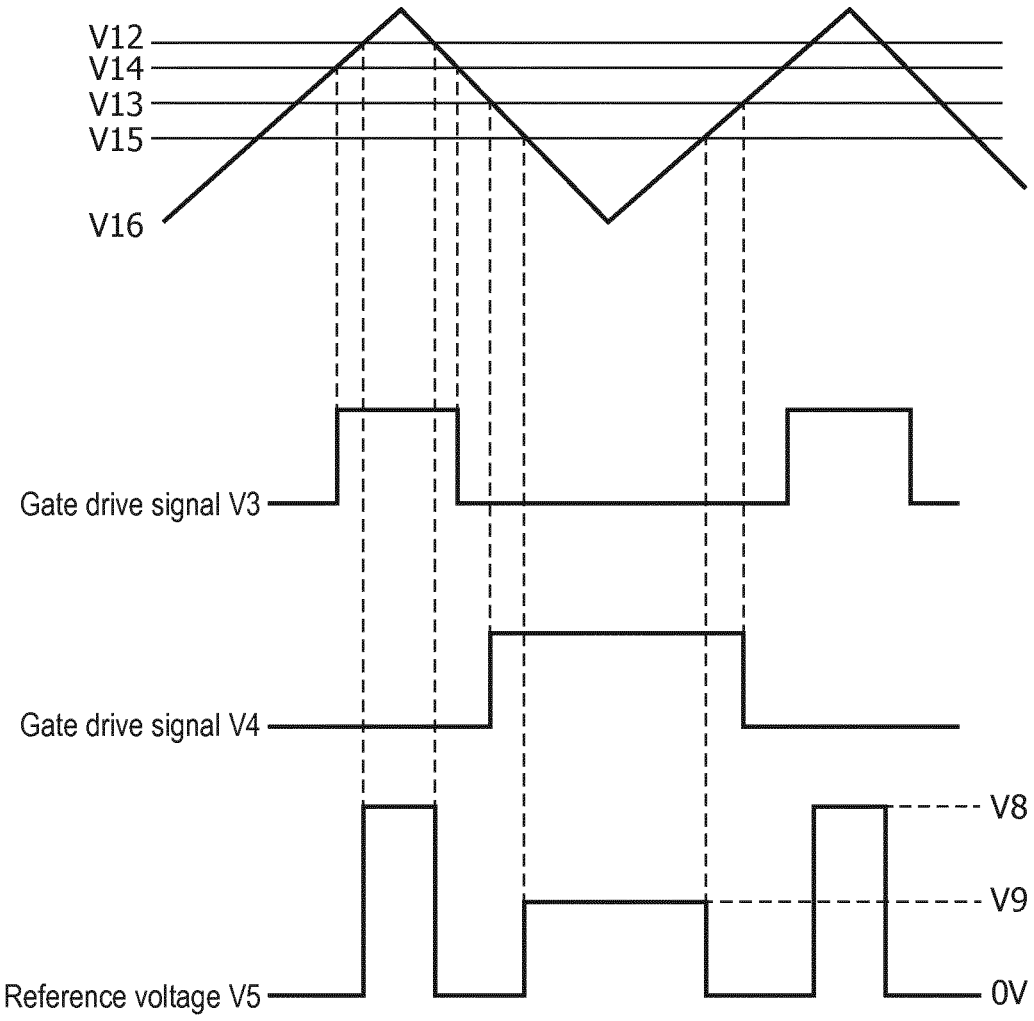
FIG. 8 is a graph of signals present in a lighting control circuit according to an embodiment.

As shown in FIG. 8, in an embodiment, drive circuit 44 operates as follows:

When comparison signal V16 rises above the value of switch signal V14, comparator 52 outputs drive signal V3. Once comparison signal V16 rises above the value of switch signal V12, comparator 50 begins to output switch drive signal V10. Next, when comparison signal V16 falls below the value of switch signal V12, comparator 50 ceases to output switch drive signal V3. Similarly, when comparison signal V16 falls below switch signal V14, comparator 52 ceases outputting drive signal V3. In this way, switch drive signal V10 begins only after drive signal V3 already begun and ceases before drive signal V3, ceases.

Comparators 54, 56 similarly output drive signal V4 and switch drive signal V11, respectively. However, because the comparison signal V16 is coupled to the negative terminals of comparators 54, 56 each will only output a signal when comparison signal V16 falls below value of the respective switch signal. Thus, comparator 54 will begin to output drive signal V4 when voltage reference signal comparison signal V16 falls below switch signal V13, and comparator 56 will begin to output switch drive signal V11 when comparison signal V16 falls below switch signal V15. Conversely, comparator 56 will cease outputting switch drive signal V11 when comparison signal V16 rises above switch signal V15, and comparator 54 will cease outputting drive signal V4 when comparison signal V16 rises above switch signal V13.

The outputs of comparators 68, 70, 72, 74 may be varied by altering the values of switch signals V12, V13, or the pulse-width of comparison signal V16. Further, instead of providing two signals, V12, V13, and deriving signals V14, V15, controller 28 may be configured to provide signals V12, V13, V14, V15 directly to comparators 50, 52, 54, 56.

It should be understood that, although FIG. 1 depicts a circuit having two LED strings 20, 22 any number LED strings may be used. In embodiments of more than two LED strings, the supporting circuitry may be expanded to accommodate the additional LED strings. For example, each additional LED string may have an associated additional switch, receiving a control signal from controller 28. Alternately, each additional switch may receive control signals from switch control circuit 44. For example, switch control circuit 44 may employ additional branches, each branch providing a drive signal and a switch drive signal for each additional LED branch.

In alternate embodiments, only one control signal, such as control signal V5, may be used to control each LED strings 14 including the additional LED strings. In this example, the switches associated with each LED string may be individually driven at unique times for a given control period, such that control signal V5 is effectively time multiplexed with each of the switches 24 and 26 being driven for a unique portion of the control signal V5 period. In alternate embodiments, two or more LED strings may be driven together for the same portion of the control signal V5 periods. In yet another embodiment, two or more channels may be used to control switches 16. For example, a single control channel may be used to control a maximum of two switches of switches 16. Thus, in an embodiment of six switches, a total of three channels would be used, each controlling two of the six switches. Additionally, in embodiments of more than two LED strings, additional current control loops 42 may be employed to control the current output when each additional LED string is receiving current. These and other variations will be obvious in conjunction with a review of this disclosure.

The current flowing through any additional LED strings may be detected and controlled by controller 28, using current control signal V1 delivered to current source 12. Alternately, current control loop 18 may detect the current flowing through each additional LED string, and adjust the current $I_{out}$ when each is illuminated.

It will further be appreciated by one of ordinary skill that multiple current control loops 42 may be implemented to control the current flowing through each LED string. For example, each current control loop may have a unique reference voltage. Thus instead of multiplexing the reference voltage for one current control loop 18, each current control loop is alternately implemented during the operation of each LED string of LED strings 14.

Figure 9:
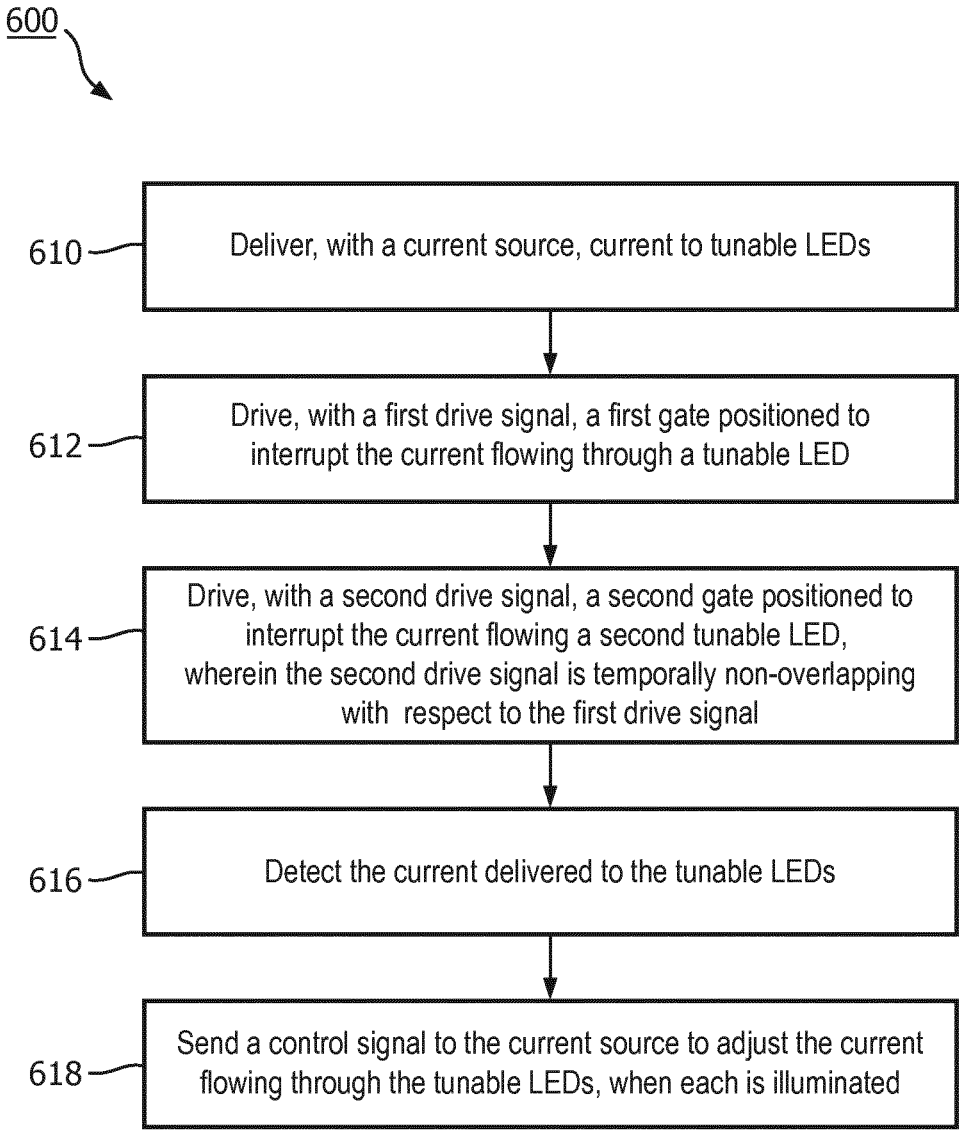
FIG. 9 is a flowchart of a method of controlling multiple LEDs according to an embodiment.

FIG. 9, in one embodiment, shows a flowchart of a method 600 for controlling multiple LEDs. The method utilizes one or more embodiments of the systems described or otherwise envisioned herein. For example, method 200 may use lighting control circuit 10 described above.

At step 610, current $I_{out}$ is provided, using current source 12, to LED strings 20, 22. In one embodiment, LED strings 20, 22 may be in parallel with respect to current source 12 such that each may independently receive current $I_{out}$.

In step 612, in one embodiment, a control signal V3 drives a first switch 24 from an open to a closed position. The first switch 24 may be positioned to interrupt current flowing through LED string 20 when in the open position. Thus, current may flow through the LED string 20 when switch 24 is in the closed position.

In step 614, a second control signal V4 drives a second switch 26, from an open to a closed position. The second switch 26 may be positioned to interrupt current flowing through LED string 22 when in the open position. Further, drive signal V3 is configured to be temporally non-overlapping with drive signal V4, so that the current is interrupted through LED strings 20, 22 at different times. Thus, LED strings 20, 22 are never in operation at the same time.

In an embodiment, drive signal V3 and V4 may be provided by a controller 28. In an alternate embodiment, drive signals V3 and V4 may be provided by switch control circuit 44.

In step 616, the current $I_{out}$ delivered to LEDs 14 is detected. In one embodiment, the current $I_{out}$ may be detected by controller 28. In an alternate embodiment, the current $I_{out}$ may be detected by a current control loop 18, as depicted in FIG. 1. The current flowing through LED strings 20, 22, in an embodiment, may be detected by measuring an input voltage V2 over a current-sense resistor.

In step 620, a current control signal V1 may be sent to the current source 12 to adjust the current $I_{out}$ flowing through LED strings 20, 22, when each is illuminated. As discussed previously, $I_{out}$ may be adjusted to ensure a consistent lumen output is achieved for each LED string 20, 22, when each is illuminated, given the relative compositions of each LED string 20, 22. Again, the current control signal V1 may be sent by controller 28, by a different controller (not shown), or by a current control loop 18 as depicted in FIG. 1.

Figure 10:
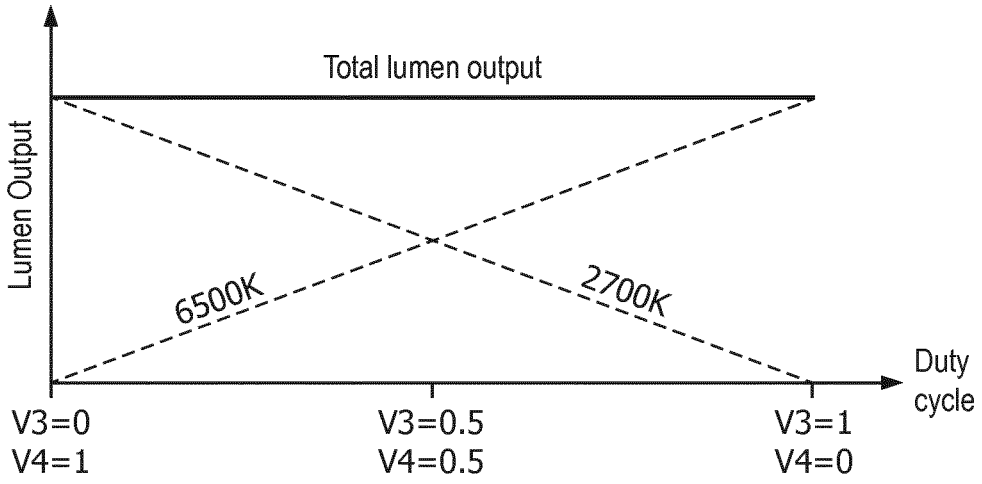
FIG. 10 is a graph of lumen output versus duty cycle for two LED strings according to an embodiment.

FIG. 10 shows a graph of how the relative lumen output of each LED string varies with the duty cycle of control signals V3, V4. The duty cycle of control signals V3, V4 is represented by the horizontal axis and the lumen output is represented by the vertical axis. In this figure, it is assumed that LED string 20 is comprised of 6500K LEDs and LED string 22 is comprised of 2700K LEDs, although any LEDs may be used. When the duty cycle of drive signal V3 is at 0%, and V4 is at 100%, LED string 20 is not illuminated and LED string 6500K is constantly on. When the duty cycle of each V3, and V4 is at 50%, the average output of each LED string 20, 22 is equal, thus the perceived lumen output will be equivalent. With respect to drive signal V3, from 0% up to, but not including, 50%, the lumen output from LED string 22 is dominant. From just after 50% to 100%, the lumen output of LED string 20 becomes dominant, as the lumen output of LED string 22 decreases.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of."

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

What is claimed is:

1. A lighting control circuit, comprising:

a controller configured to generate a first drive signal, a second drive signal, the second drive signal being temporally non-overlapping with respect to the first drive signal;

a reference control circuit configured to generate a reference voltage;

a current source configured to deliver a current to a first LED and a second LED, wherein the current is proportional to the reference voltage so that a desired value of the current is achieved when the reference voltage has a high value;

a first switch configured to switch from an open position, when driven by the first drive signal having a low value, to a closed position when driven by the first drive signal having a high value, wherein the first switch is positioned to interrupt current flow through the first LED when the first switch is in the open position; and a second switch configured to switch from an open position, when driven by the second drive signal having a low value, to a closed position when driven by the second drive signal having a high value, wherein the second switch is positioned to interrupt current flow through the second LED when the second switch is in the open position, wherein the reference control circuit is arranged to generate the high value of the reference voltage only after one of the first drive signal and the second drive signal has the high value, and wherein the current from the current source is adjustable by a current control loop that is configured to receive the reference voltage as an input, wherein the reference control circuit comprises:

a first voltage source having a first voltage value being configured to set the value of the reference voltage to the first voltage value when a first switch is in a closed position; and a second voltage source having a second voltage value being configured to set the value of the reference voltage to the second voltage value when a second switch is in a closed position.

2. The lighting control circuit of claim 1, wherein the first LED and the second LED emit contrasting color temperatures during operation.

3. The lighting control circuit of claim 1, wherein the controller is configured to alter brightness of the first LED and the second LED by adjusting a duty cycle of the first drive signal and a duty cycle of the second drive signal.

4. The lighting control circuit of claim 1, wherein the current control loop comprises:

an error amplifier, configured to receive at a first input a sense voltage being proportional the current flowing through LED strings, and to receive at a second input the reference voltage, and to output an error voltage, wherein the error voltage is proportional to the difference between the sense voltage and the reference voltage;

a comparator, configured to receive at a first input the error voltage, and at a second input a comparison voltage, the comparison voltage being a sawtooth wave, and to output a control voltage, wherein the duty cycle of the control voltage is set by the magnitude of the error voltage, wherein the current source is configured to adjust the magnitude of the output current in proportion to the duty cycle of the control voltage.

5. The lighting control circuit of claim 4, wherein the reference voltage is set to 0V for a first time period and a second time period, wherein the first time period begins after the first switch is in the closed position and before the second switch is in the open position, wherein the second time period begins after the second switch is in the closed position and before the first switch is in the open position.

6. The lighting control circuit of claim 1, wherein the reference voltage is set to the first value for a first time period, wherein the first time period begins after the first switch is in the closed position, and ends before the first switch is in the open position, and is set to the second value for a second time period, wherein the second time period begins after the second switch is in the closed position, and ends before the second switch is in the open position.

7. The lighting control circuit of claim 1, wherein the first switch is driven into a closed position by a first switch drive signal and the second switch is driven into a closed position by a second switch drive signal.

8. The light control circuit of claim 7, further comprising: a switch control circuit, comprising:

a first branch, including a first comparator configured to output the first drive signal when the value of a comparison signal exceeds the value of a first switch signal, and including a second comparator configured to output the first switch drive signal when the value of the comparison signal exceeds the value of a second switch signal; and a second branch, including a third comparator configured to output the second drive signal when the value of the comparison signal falls below the value of a third switch signal, and including a fourth comparator configured to output the second switch drive signal when the value of the comparison signal falls below the value of a fourth switch signal.

9. The lighting control circuit of claim 8, wherein the value of the second switch signal is higher than the value of the first switch signal, the value of the first switch signal is higher than the value of the third switch signal and the value of the third switch signal is higher than the value of the fourth switch signal.

10. The lighting control circuit of claim 1, wherein the controller is configured to detect the current delivered to the first LED and the second LED, and to a send a control signal to the current source to adjust the current such that a desired lumen output is achieved for both the first LED and the second LED, when each is illuminated.

11. A lighting control method, comprising the steps of:

delivering, with a current source, a current, proportional to a reference voltage, to a first LED and second LED;

driving, with the first drive signal, a first switch from an open position to a closed position, wherein the first switch is configured to interrupt the current flow through the first LED when the first switch is in the open position; and driving, with the second drive signal, a second switch from an open position to a closed position, wherein the second drive signal is temporally non-overlapping with respect to the first drive signal, wherein the second switch is configured to interrupt current flow through the second LED when the second switch is in the open position, wherein the reference voltage is set to a high signal after one of the first drive signal and the second drive signal is high, and wherein the current from the current source is adjustable by a current control loop that is configured to receive the reference voltage as an input wherein, a first voltage source having a first voltage value sets the value of the reference voltage to the first voltage value when a first switch is in a closed position; and a second voltage source having a second voltage value sets the value of the reference voltage to the second voltage value when a second switch is in a closed position.

12. The lighting control method of claim 11, further comprising the steps of:

detecting the current delivered to the first LED and the second LED, and sending a second control signal to the current source to adjust the current such that a desired lumen output is achieved for both the first LED and the second LED, when each is illuminated.

13. The lighting control method of claim 12, wherein the step of sending the second control signal is performed by the current control loop.

* * * * *